US009423153B2

(12) United States Patent
Nguyen et al.

(10) Patent No.: US 9,423,153 B2
(45) Date of Patent: Aug. 23, 2016

(54) UNREGULATED INTEGRATED FUNCTION GAS VALVE FOR A WATER HEATER

(75) Inventors: Can Trong Nguyen, Anaheim, CA (US); Raymond Joubran, Pasadena, CA (US)

(73) Assignee: Robertshaw Controls Company, Itasca, IL (US)

( * ) Notice: Subject to any disclaimer, the term of this patent is extended or adjusted under 35 U.S.C. 154(b) by 2223 days.

(21) Appl. No.: 12/419,348

(22) Filed: Apr. 7, 2009

(65) Prior Publication Data

US 2010/0252122 A1 Oct. 7, 2010

(51) Int. Cl.

| | |
|---|---|
| ***F23N 5/10*** | (2006.01) |
| ***F24H 9/20*** | (2006.01) |
| ***F24H 1/18*** | (2006.01) |

(52) U.S. Cl.

CPC ..... *F24H 9/2035* (2013.01); *F23N 5/107* (2013.01); *F24H 1/186* (2013.01); *F23N 2035/24* (2013.01); *Y10T 137/1819* (2015.04)

(58) Field of Classification Search

USPC ..... 122/14.1–14.21; 137/65, 66, 94, 137/625.15, 625.19, 862; 236/93 R; 431/21, 431/51–54, 58–60

See application file for complete search history.

(56) References Cited

U.S. PATENT DOCUMENTS

| | | | | | |
|---|---|---|---|---|---|
| 2,945,369 | A | * | 7/1960 | Seegert | 431/54 |
| 3,159,346 | A | * | 12/1964 | Caparone et al. | 236/33 |
| 3,447,746 | A | * | 6/1969 | Visos | 236/21 B |
| 3,477,641 | A | * | 11/1969 | Fairley et al. | 236/1 R |
| 3,762,639 | A | * | 10/1973 | Katchka et al. | 236/15 A |
| 3,841,552 | A | * | 10/1974 | Kinsella et al. | 236/99 R |
| 3,861,586 | A | * | 1/1975 | Katchka | 236/1 H |
| 3,861,587 | A | * | 1/1975 | Katchka | 236/1 H |
| 3,915,378 | A | * | 10/1975 | Kinsella et al. | 236/99 R |
| 4,422,844 | A | * | 12/1983 | Graham et al. | 431/72 |
| 4,543,974 | A | * | 10/1985 | Dietiker et al. | 137/66 |
| 5,193,993 | A | * | 3/1993 | Dietiker | 431/51 |
| 5,484,103 | A | * | 1/1996 | Schultz | 236/68 D |
| 5,787,917 | A | * | 8/1998 | Park et al. | 137/38 |
| 5,931,655 | A | | 8/1999 | Maher, Jr. | |
| 6,010,327 | A | * | 1/2000 | Katchka | 431/75 |
| 6,571,829 | B2 | * | 6/2003 | Kuriyama et al. | 137/630.2 |
| 6,604,540 | B2 | * | 8/2003 | Kuriyama et al. | 137/66 |
| 6,634,351 | B2 | * | 10/2003 | Arabaolaza | 126/39 G |
| 7,169,489 | B2 | | 1/2007 | Redmond | |
| 7,252,109 | B2 | * | 8/2007 | Colombo | 137/66 |
| 7,346,274 | B2 | | 3/2008 | Bradenbaugh | |
| 7,703,470 | B2 | * | 4/2010 | Wu | 137/66 |
| 2003/0150404 | A1 | * | 8/2003 | Lesage | 122/13.01 |
| 2004/0016769 | A1 | | 1/2004 | Redmond | |
| 2004/0023087 | A1 | | 2/2004 | Redmond | |

(Continued)

FOREIGN PATENT DOCUMENTS

| | | |
|---|---|---|
| EP | 0 945 680 A1 | 9/1999 |
| EP | 0 945 680 B1 | 8/2003 |

(Continued)

*Primary Examiner* — Matthew W Jellett

(74) *Attorney, Agent, or Firm* — Reinhart Boerner Van Deuren P.C.

(57) ABSTRACT

An unregulated gas valve for a water heater that includes an inlet configured to receive a gas flow into the gas valve, an outlet configured to direct a portion of the gas flow to a combustion chamber, a pilot line configured to direct a portion of the gas flow to a pilot flame, and a dial configured to regulate the flow of gas into the gas valve, and further configured to select a water temperature setting.

29 Claims, 12 Drawing Sheets

(56) References Cited

U.S. PATENT DOCUMENTS

| | | | | |
|---|---|---|---|---|
| 2004/0177817 | A1 | 9/2004 | Bradenbaugh | |
| 2006/0219285 | A1* | 10/2006 | Nguyen | 136/230 |
| 2007/0051243 | A1 | 3/2007 | Boutall et al. | |
| 2007/0183758 | A1 | 8/2007 | Bradenbaugh | |
| 2007/0259220 | A1 | 11/2007 | Redmond | |
| 2008/0087233 | A1* | 4/2008 | Waller et al. | 122/14.1 |
| 2010/0212602 | A1* | 8/2010 | Haddad et al. | 122/13.01 |

FOREIGN PATENT DOCUMENTS

| | | | |
|---|---|---|---|
| WO | WO 2004/024845 | A2 | 3/2004 |
| WO | WO 2004/050798 | A2 | 6/2004 |
| WO | WO 2005/094273 | A2 | 10/2005 |

* cited by examiner

FIG. 10
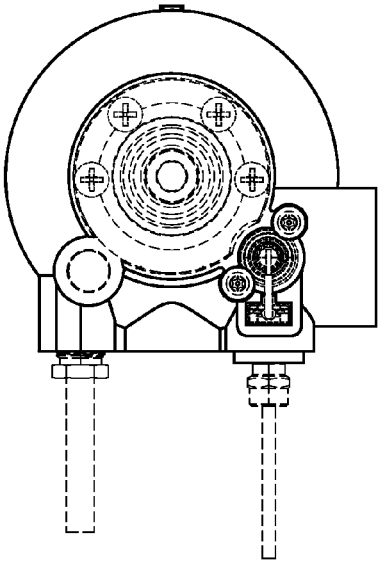
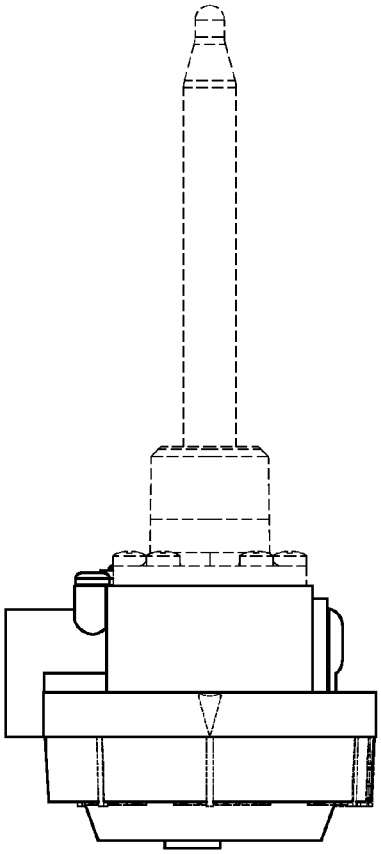
FIG. 11
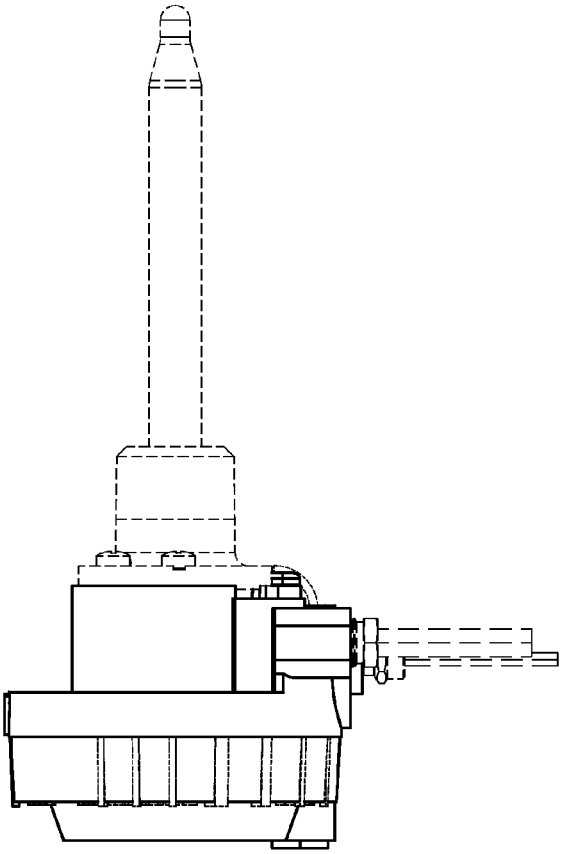
FIG. 12

UNREGULATED INTEGRATED FUNCTION GAS VALVE FOR A WATER HEATER

CROSS-REFERENCE TO RELATED PATENT APPLICATIONS

This patent claims the benefit of U.S. Provisional Patent Application No. 60/162,966, filed Mar. 24, 2009, the entire teachings and disclosure of which are incorporated herein by reference thereto.

FIELD OF THE INVENTION

This invention relates generally to water heaters, and more specifically to gas valves for water heaters.

BACKGROUND OF THE INVENTION

In a gas water heater, the water heating and temperature control system typically includes a combustion chamber located beneath a water tank and a gas heating element in the combustion chamber. The flow of gas to the combustion chamber is controlled by a gas valve assembly. The gas valve may include an elongate temperature probe assembly configured to sense the temperature of water in the water tank. The temperature probe assembly typically includes an invar rod disposed within a copper tube, and is often assembled to the gas valve assembly such that the temperature probe assembly protrudes from the gas valve assembly at roughly a right angle to a longitudinal axis of the gas valve assembly.

The temperature sensing probe is assembled to valve components, which are configured to open or close the flow of gas in a particular channel of the gas valve. Generally, the copper tube and invar rod assembly are configured to be positioned inside the water tank. The copper tube, having a high thermal coefficient of expansion, expands and contracts as the water temperature in the tank increases and decreases, respectively. The expansion and contraction of the copper tube acts to move the invar rod. Typically, as the water in the tank cools, the invar rod contracts and, by contracting, pushes against a lever, which causes the gas valve to allow the main gas or bleed gas to flow to the outlet of the valve and into the combustion chamber.

While regulated gas valves are common in the U.S., in some countries, it is more common to have unregulated gas valves. These unregulated gas valves typically include a gas cock to regulate the flow of gas into the valve, and a temperature adjustment knob to select a desired temperature setting. However, these unregulated gas valves do not typically have a safety feature to prevent the flow of gas to the valve in the event of a fire. Moreover, the use of two controls (i.e., the gas cock and temperature control knob) to operate the gas valve adds to both the parts cost and the assembly cost of the gas valve. And with two controls, there are two potential points of failure. As such, reducing the number of controls required to operate the unregulated gas valve could improve the reliability of the valve.

It would therefore be desirable to have an unregulated gas valve that combines the two gas valve controls into one control to save parts and assembly costs and improve reliability. It would also be desirable to have a gas valve that includes a safety feature that can prevent the flow of gas into the valve if the control knob is exposed to a fire.

Embodiments of the invention provide such an unregulated gas valve. These and other advantages of the invention, as well as additional inventive features, will be apparent from the description of the invention provided herein.

BRIEF SUMMARY OF THE INVENTION

In one aspect, an embodiment of the invention provides an unregulated gas valve for a water heater that includes an inlet configured to receive a gas flow into the gas valve, an outlet configured to direct a portion of the gas flow to a combustion chamber, a pilot line configured to direct a portion of the gas flow to a pilot flame, and a dial configured to regulate the flow of gas into the gas valve, and further configured to select a water temperature setting.

In another aspect, an embodiment of the invention provides a gas valve that includes a valve body configured to provide a flow path for a gas to a pilot line, and further configured to provide a flow path for the gas to an outlet, and a safety magnet disposed within the valve body, wherein the safety magnet, in a first position, is configured to prevent the flow of gas into the valve body, and wherein the safety magnet, in a second position, is configured to permit the flow of gas into the valve body. The gas valve further includes a pilot valve disposed within the valve body, wherein the pilot valve, in a first position, is configured to prevent the flow of gas to the pilot line, and wherein the pilot valve, in a second position, is configured to permit the flow of gas to the pilot line, a temperature adjustment screw disposed within the valve body, the temperature adjustment screw configured to vary a water temperature setting, and a dial configured to control a position of each of the temperature adjustment screw, the pilot valve, and the safety magnet.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 10 is a back view of the gas valve assembly;

FIG. 11 is a top view of the gas valve assembly;

FIG. 12 is a side view of the gas valve assembly;

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
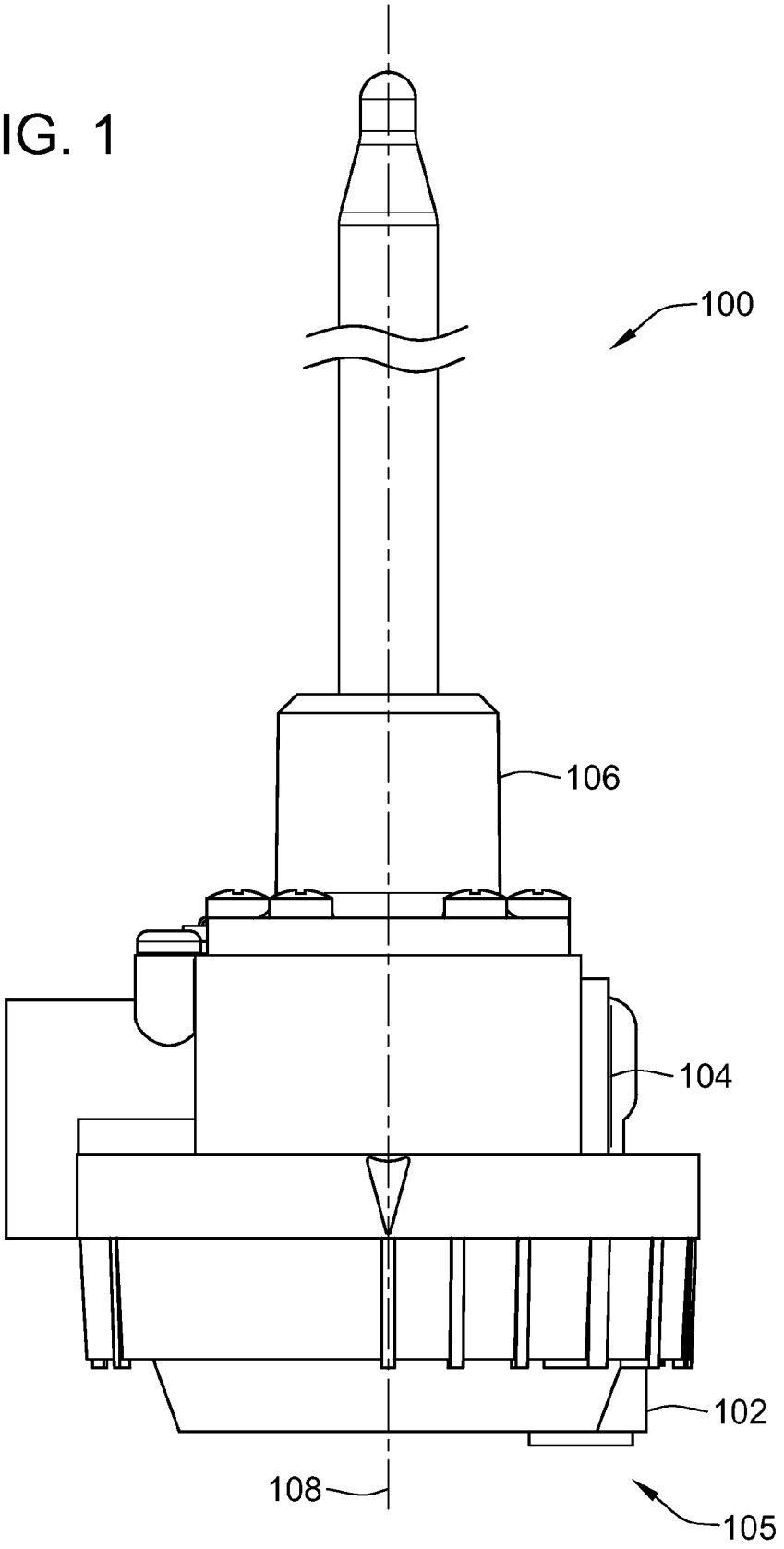
FIG. 1 is a top view of a gas valve assembly according to an embodiment of the invention.

FIG. 1 illustrates a top view of an unregulated gas valve 100 according to an embodiment of the invention. The gas valve 100 includes a plastic disk-shaped dial 102 attached to a similarly disk-shaped valve body 104. A shank 106 is attached a side of the valve body 104 opposite the dial 102. The shank 106 is essentially annular and has a longitudinal axis 108 that is also the central axis of dial 102. In one embodiment, the valve body 104 has threaded openings and is attached to the dial 102 and shank 106 using screws assembled into the threaded openings.

Having the central axis of the dial 102 aligned with the longitudinal axis 108 of the shank 106 reduces the cost of assembly in that fixturing for the components is made simpler and less expensive. Having multiple concentric components can also result in a speedier manufacturing process in that the multiple components can be located using a common reference point during assembly. Packaging is also made simpler and less expensive as the molds used to make plastic packing materials, for example, are easier to design and manufacture than molds to make packing materials for assemblies with a variety of non-concentric components.

Figure 2:
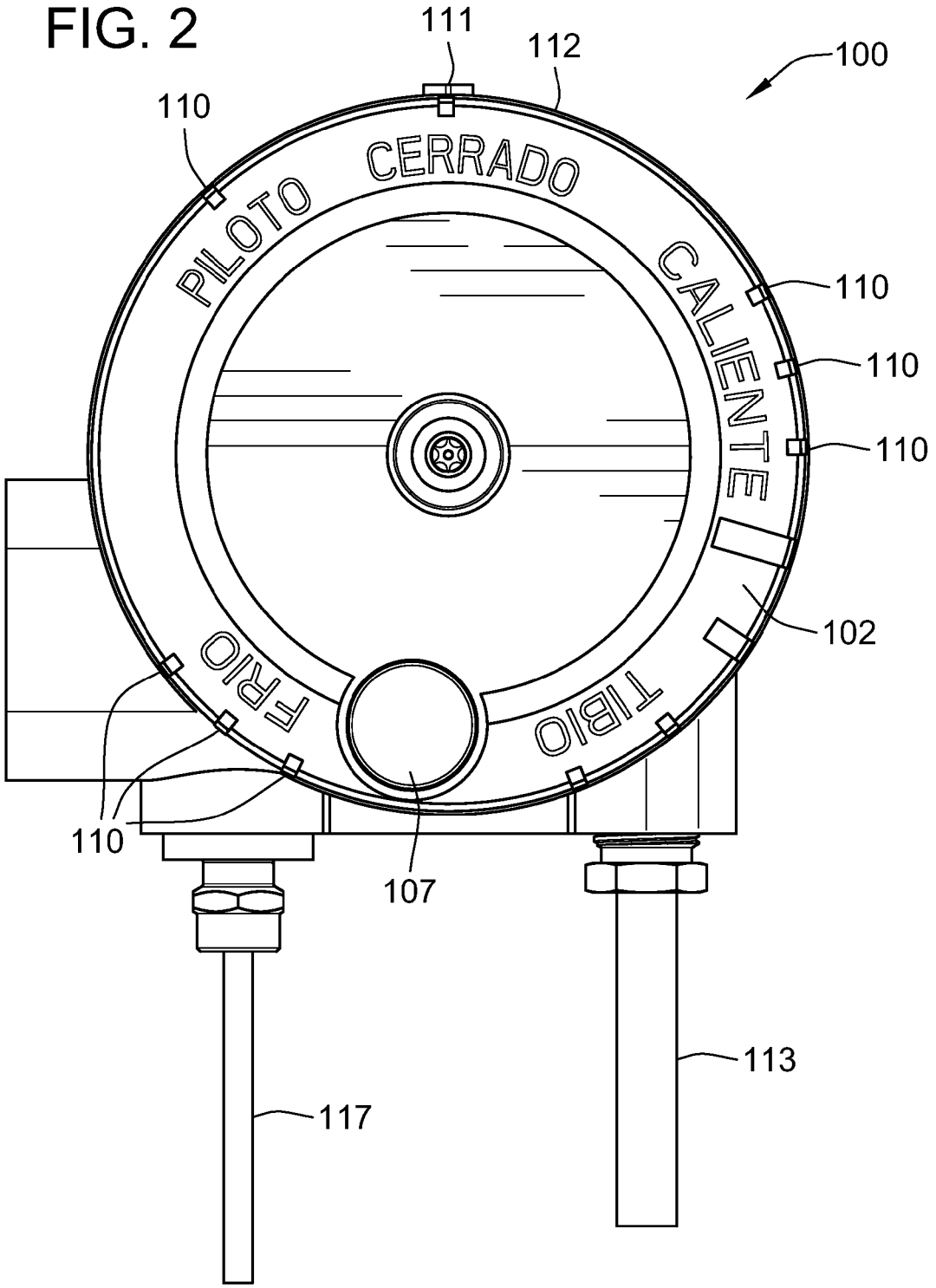
FIG. 2 is a front view of the gas valve assembly illustrated in FIG. 1.

FIG. 2 illustrates a front view of the gas valve 100 according to an embodiment of the invention. The front 105 of the dial 102 includes a plurality of markings 110 on a perimeter wall 112 of the dial 102. The front 105 of dial 102 also includes a reset button 107 and a plurality of labels, each label associated with one or more of the plurality of markings 110, wherein each label describes the function to be performed when the marking associated with that label is aligned with a fixed reference 111 on the valve body 104. In the embodiment shown in FIG. 2, the plurality of labels includes CERRADO (OFF), PILOTO (PILOT), FRIO (COLD), TIBIO (WARM), and CALIENTE (HOT). A pilot line 113 and a thermocouple 117 are attached to the valve body 104. In one embodiment, the pilot line 113 and the thermocouple 117 are attached using fittings that are threaded into openings in the valve body 104.

Figure 3A:
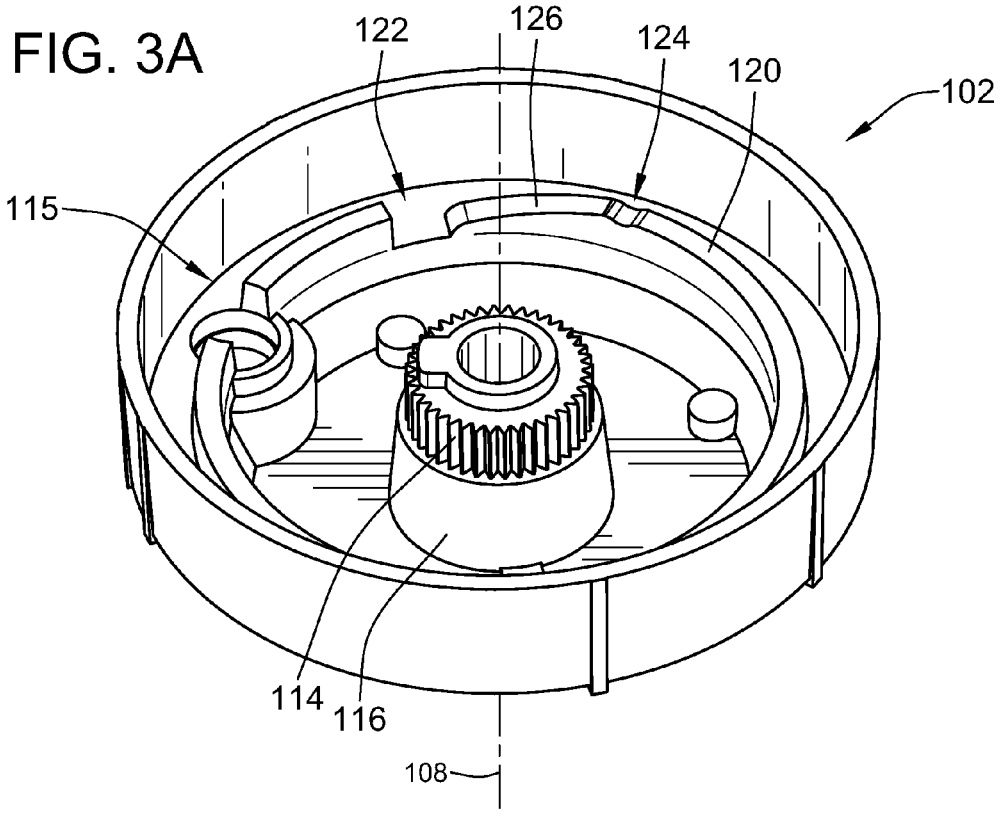
FIG. 3A is a pictorial view of a dial usable in the gas valve assembly of FIG. 1 according to an embodiment of the invention.
Figure 3B:
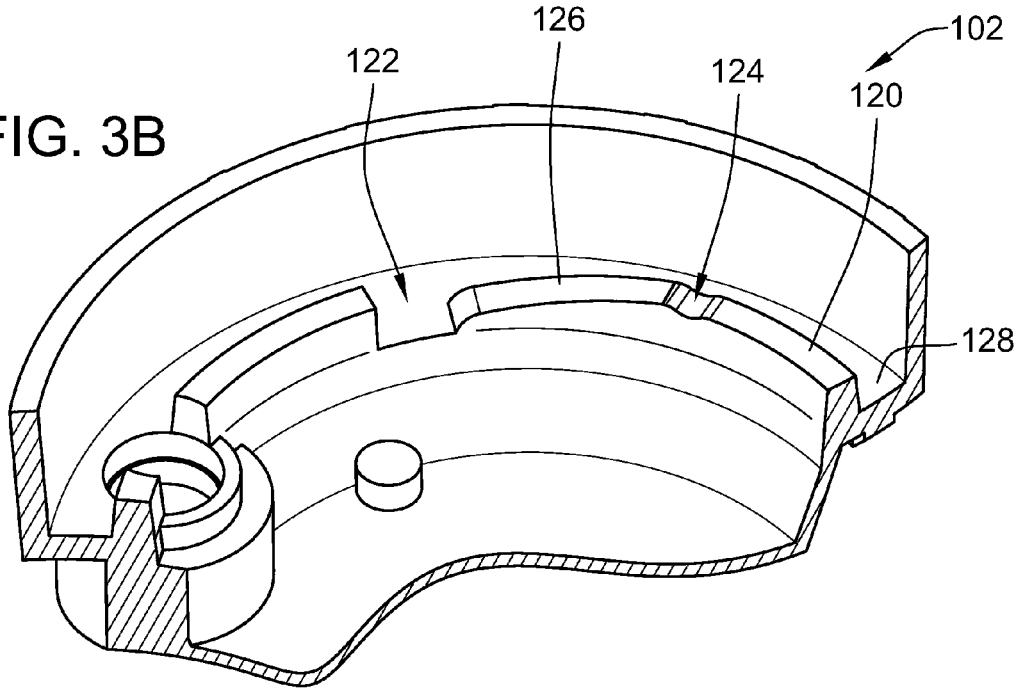
FIG. 3B is a closeup view of a section of the dial illustrated in FIG. 3A.

FIG. 3A illustrates a back side 115 of dial 102 according to an embodiment of the invention. In the embodiment shown, the dial 102 is made from plastic and includes a molded-in or integral gear 114 at the center of the back side 115 of dial 102. The gear 114 is formed onto a cylindrical projection 116 at the center of the back side 115 of dial 102, which also includes a raised ridge 120. The ridge 120 is circular and concentric with the perimeter wall 112. FIG. 3B shows a closeup of the ridge 120 that includes a slot 122, which serves as a recess for a pilot valve 172 (shown in FIG. 6) when the dial 102 is in the off (CERRADO) position. Ridge 120 also has a notch 124 separated from slot 122 by a ramp 126. The notch 124 serves as a recess for the pilot valve 172 when the dial is in the pilot (PILOTO) position. Along the ramp 126, the height of ridge 120, relative to a back side surface 128, increases from a first height at slot 122 to a second greater height at notch 124. It is along the ramp 126, from slot 122 to notch 124, that the pilot valve 172 transitions from a closed position (i.e., no gas flow to pilot line 113) to an open position (i.e., gas flows to pilot line 113).

Figure 4:
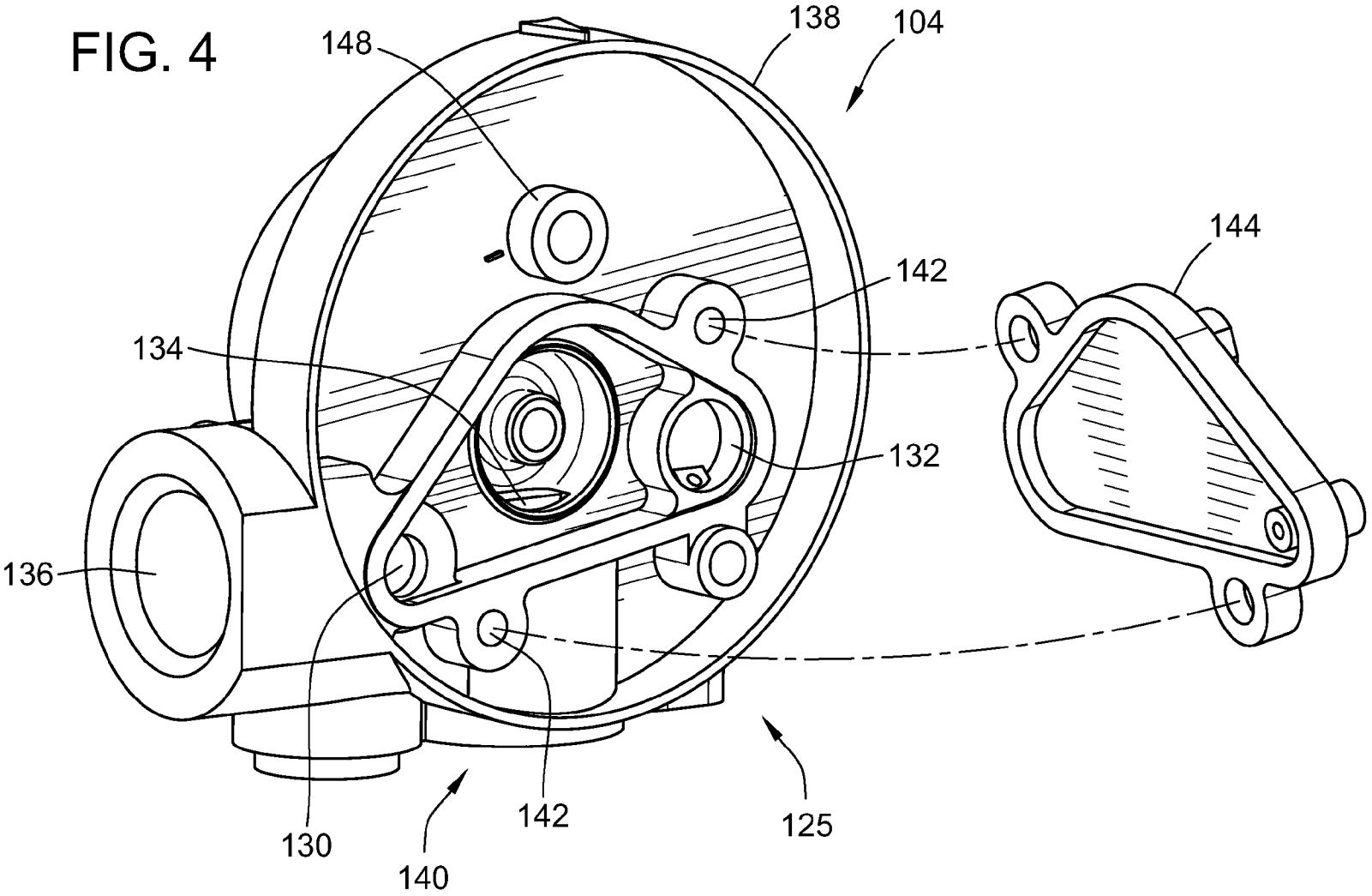
FIG. 4 is a pictorial view of a valve body and valve cover usable in the gas valve assembly illustrated in FIG. 1 according to an embodiment of the invention.

FIG. 4 illustrates a view of the valve body 104 that shows an interior portion 125 having a safety magnet port 130, a pilot valve port 132, and an outlet port 134. The valve body 104 further includes an inlet 136 located at a perimeter wall 138 of the valve body 104. An outlet 140 is also located at the perimeter wall 138. In one embodiment, the outlet 140 is spaced along the perimeter wall 138 roughly 90 degrees apart from the inlet 136. In an alternate embodiment, inlet 136 is spaced roughly 180 degrees apart from the outlet 140.

In the embodiment shown in FIG. 4, the inlet 136 provides an opening that puts the interior portion 125 of valve body 104 in fluid communication with an exterior gas supply (not shown) configured to connect to the inlet 136. Safety magnet port 130 is located adjacent to the inlet 136. Pilot valve port 132 connects the interior portion 125 to the pilot line 113. Outlet port 134 connects the interior portion 125 to the outlet 140. The interior portion 125 also includes a plurality of openings 142 for attaching a valve cover 144 to the interior portion 125 of the valve body 104. The valve cover 144 is configured to contain gas from the inlet 136 as it flows to the outlet 140 and the pilot line 113. An opening 148 in the valve body 104 is for a temperature adjustment screw 154 (shown in FIG. 5), which is configured to pass through the opening 148 such that part of temperature adjustment screw 154 resides in the interior portion 125 and part resides in an interior space 135 opposite the interior portion 125.

Figure 5:
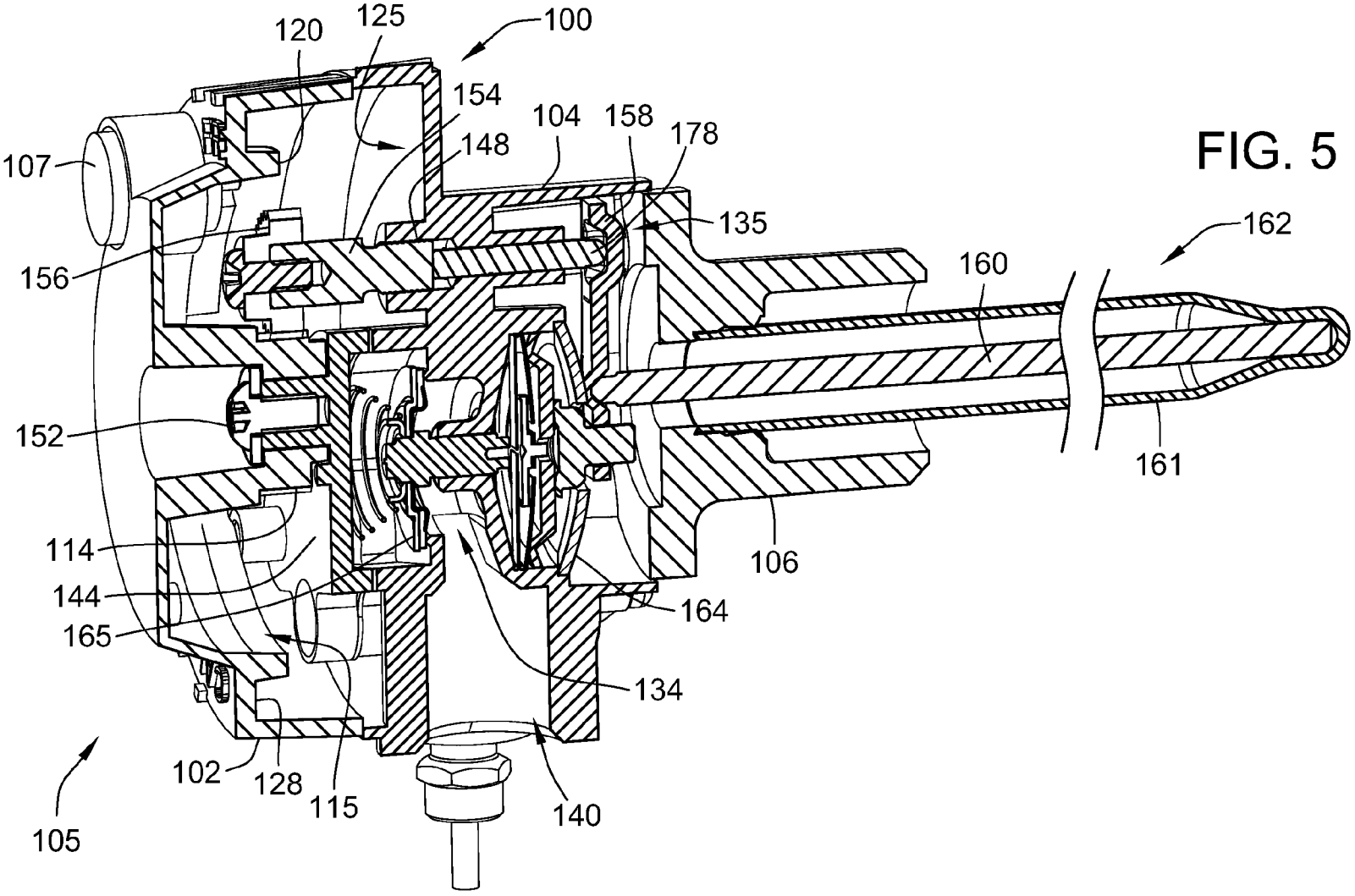
FIG. 5 is a cross-sectional view of the gas valve assembly according to an embodiment of the invention.

FIG. 5 illustrates a cross-sectional view of a gas valve assembly 100 according to an embodiment of the invention. In this embodiment, the dial 102 is attached to the valve body 104 by a screw 152 that threads into an opening in the valve cover 144 through a center opening in the dial 102. At one end, the temperature adjustment screw 154 includes a gear 156 configured to engage the gear 114 on the dial 102. The temperature adjustment screw 154 is threaded into the opening 148 on the valve body 104, and is partly disposed in the interior portion 125 and partly disposed in interior space 135. At the end of the temperature adjustment screw 154 opposite the gear 156, the temperature adjustment screw 154 has a tip 178, in interior space 135, that contacts a lever 158. In interior space 135, the lever 158 also contacts an invar rod 160 that is part of a temperature probe assembly 162 that also includes a copper tube 161. On a side of the lever 158 opposite the invar rod 160, the lever 158 contacts a diaphragm 164 configured to regulate a gas flow from the interior portion 125 to the outlet 140. The diaphragm 164 is coupled to a seal 165 that controls the flow of gas though the outlet port 134 to the outlet 140. The temperature probe assembly 162, including the invar rod 160, is supported by the shank 106, which is removably attached to the valve body 104 by screws or other suitable means.

Figure 6:
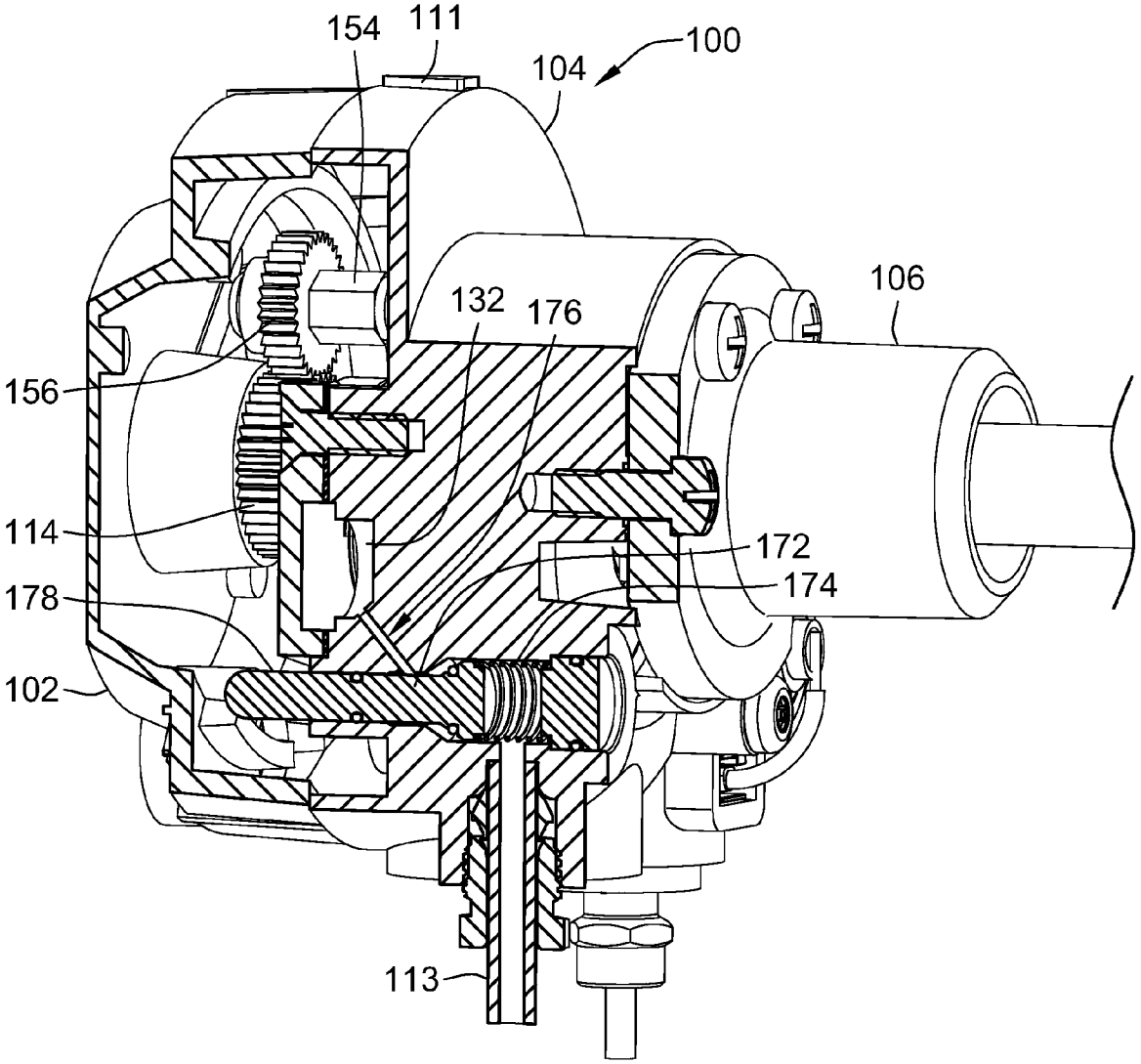
FIG. 6 is a cross-sectional view of the gas valve assembly showing a pilot valve according to an embodiment of the invention.

FIG. 6 illustrates a cross-sectional view of a gas valve assembly 100 according to an embodiment of the invention. The gas valve 100 includes a pilot valve 172, and a spring 174, which biases the pilot valve 172 toward the closed position (i.e., no gas flow to the pilot line 113). The valve body 104 further includes a passageway 176 through which gas may flow from the pilot valve port 132 to the pilot line 113 when the pilot valve is in the open position (shown in FIG. 7).

When the dial 102 is rotated to the off (CERRADO) position (i.e., the marking 110 above CERRADO is aligned with fixed reference 111), the tip 178 of the pilot valve 172 drops into the slot 122 (shown in FIG. 3B) in ridge 120 (shown in FIG. 3B) on the back side 115 of dial 102. When the tip 178 of the pilot valve 172 drops into the slot 122, the pilot valve 172 seals against the passageway 176, thus preventing the flow of gas to the pilot line 113. The pilot valve 172 is held in the slot 122 by the force of the spring 174. When the pilot valve 172 is closed, there is no pilot flame, and the safety magnet 182 (shown in FIG. 8) is not energized, and gas flow to the pilot line 113 and the outlet 140 is blocked.

Figure 7:
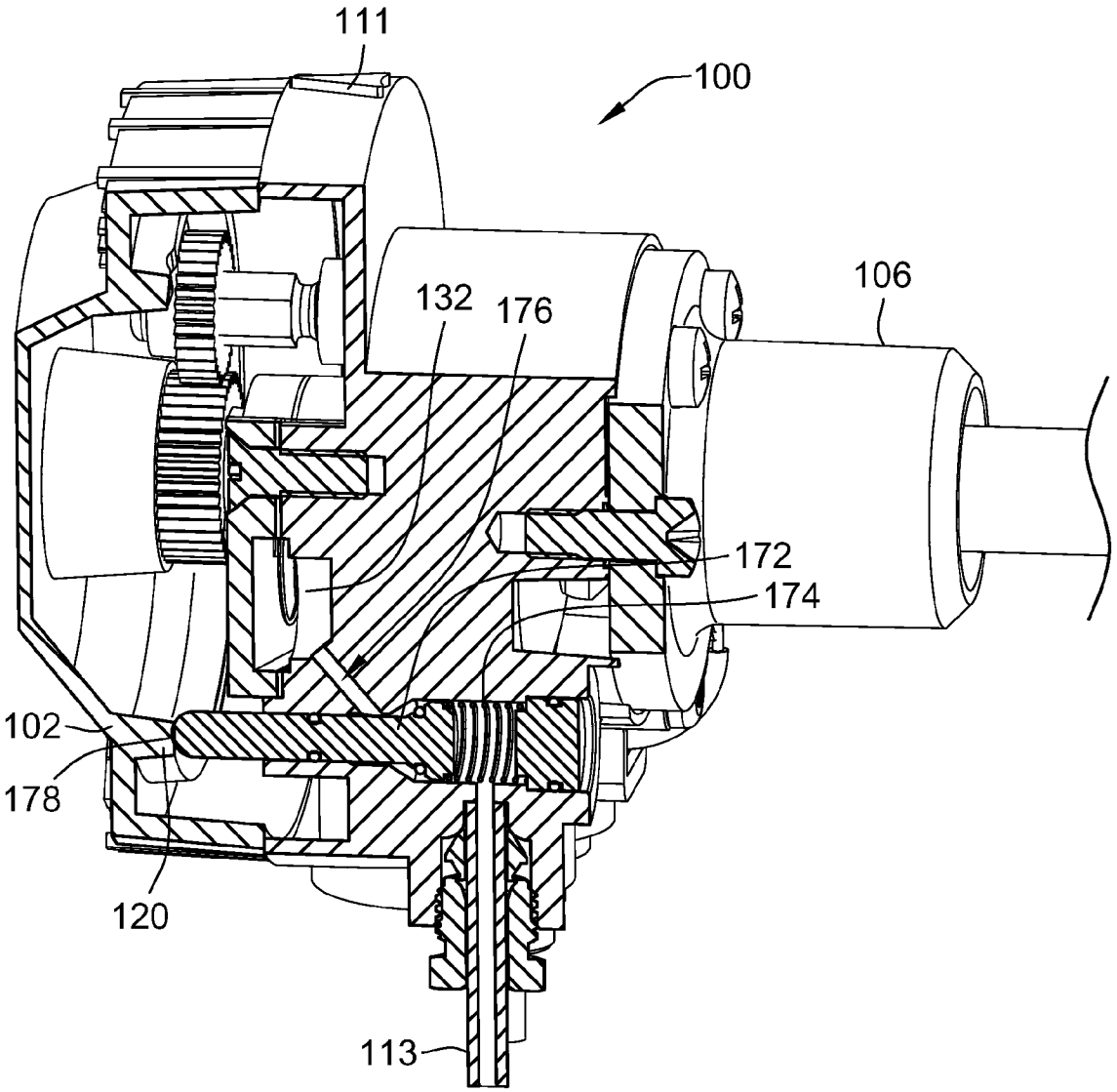
FIG. 7 is a cross-sectional view of the gas valve assembly illustrated in FIG. 6 showing the pilot valve in a different position.

To ignite the pilot flame, the dial 102 is rotated until the marking 110 above the label PILOTO (pilot) is aligned with the fixed reference 111. As the dial 102 is rotated, the pilot valve 172 moves from slot 122 along ramp 126 to notch 124. As the pilot valve 172 moves along the ramp 126, the pilot valve 172 moves against the spring 174 toward the shank 106, such that the pilot valve 172 no longer seals the passageway 176. FIG. 7 illustrates a cross-sectional view of the gas valve assembly 100 that shows the position of the pilot valve 172 when the dial 102 is rotated to PILOTO. When the dial 102 is in this position, there is a gas flow path from the passageway 176 to the pilot line 113.

Figure 8:
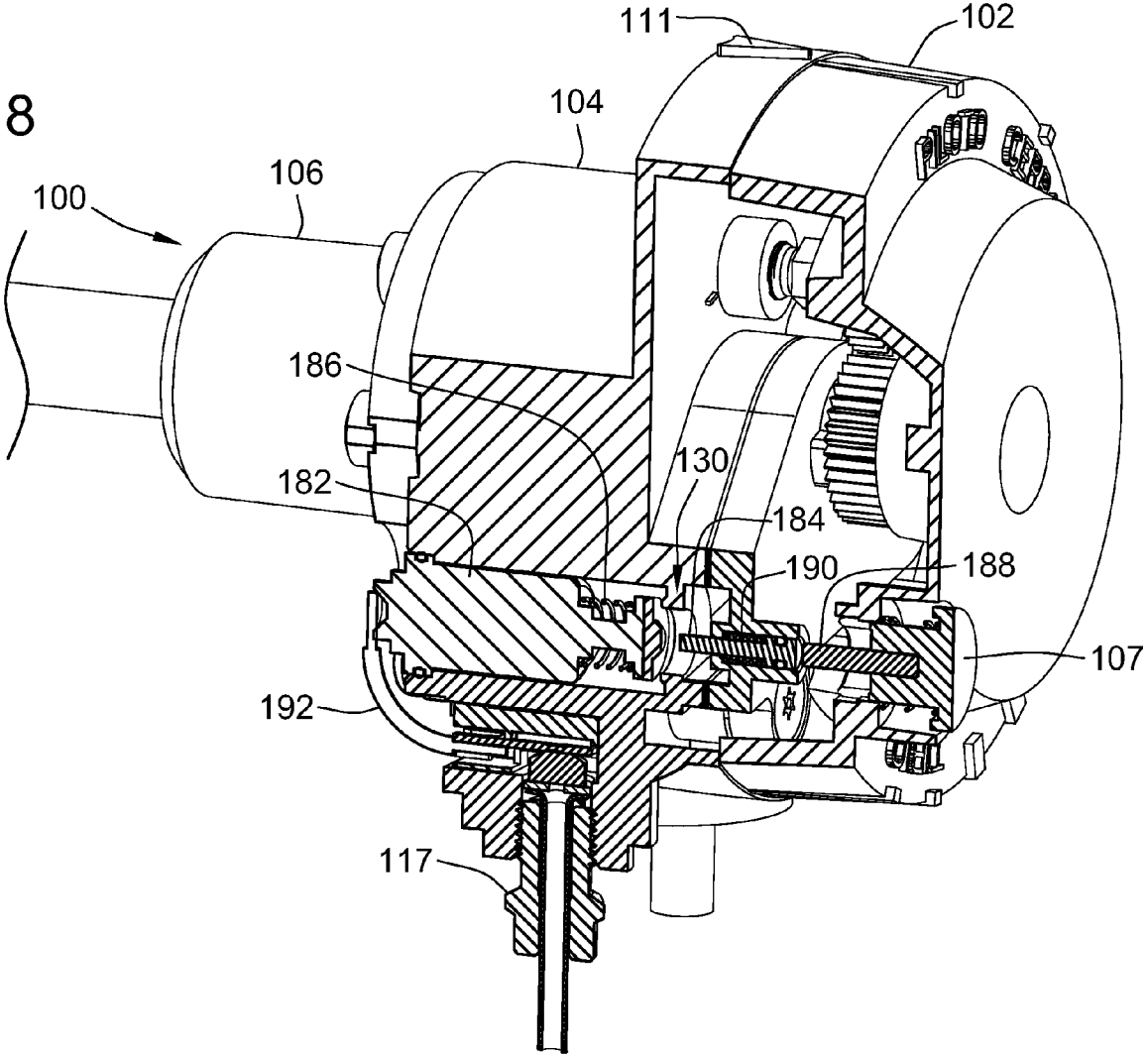
FIG. 8 is a cross-sectional view of the gas valve assembly showing a thermocouple and a safety magnet according to an embodiment of the invention.
Figure 9:
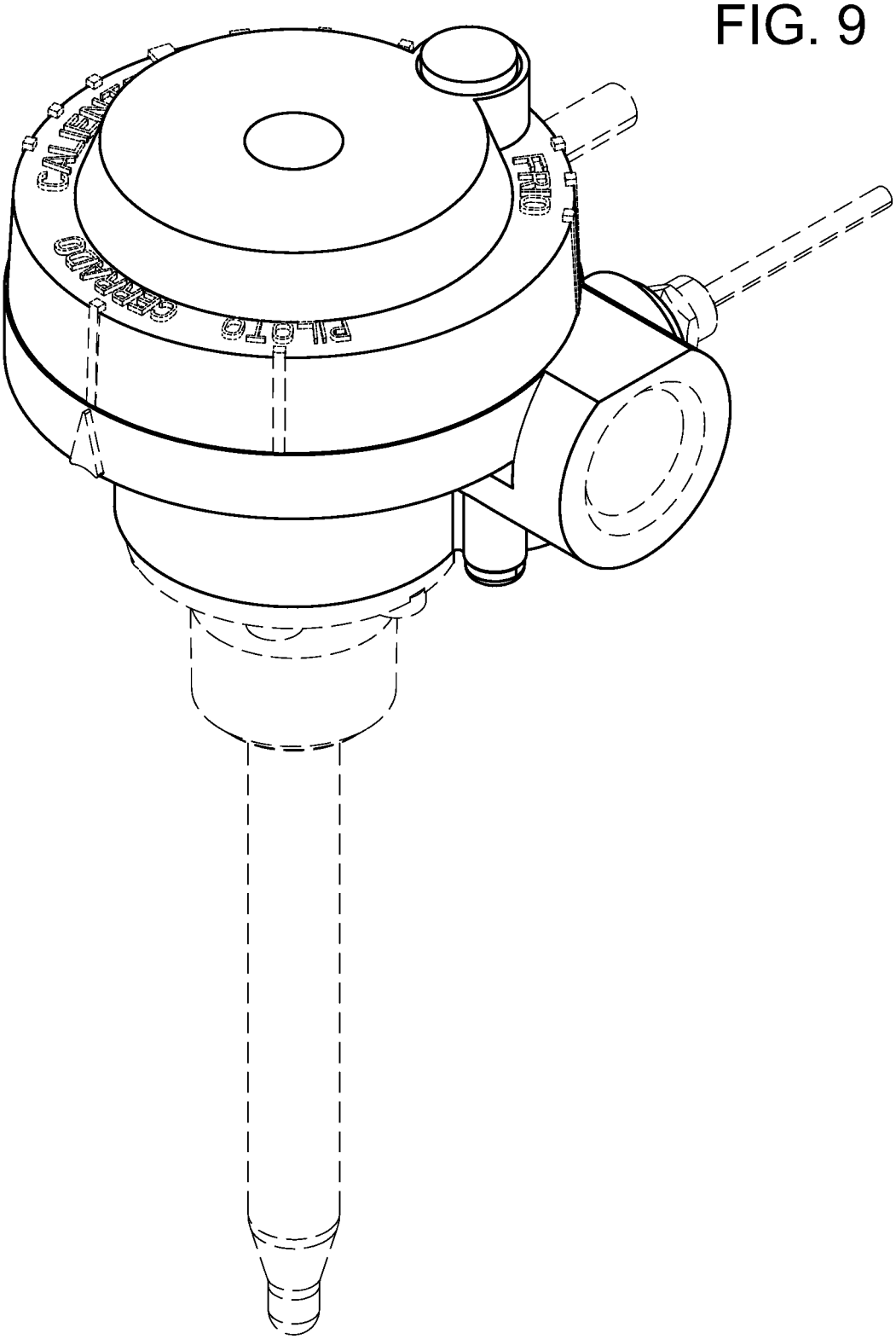
FIG. 9 is a perspective view of the gas valve assembly.
Figure 13:
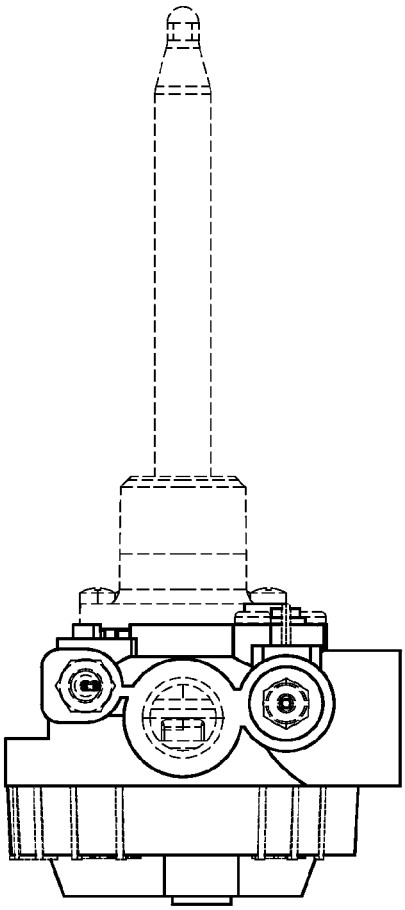
FIG. 13 is a bottom view of the gas valve assembly.
Figure 14:
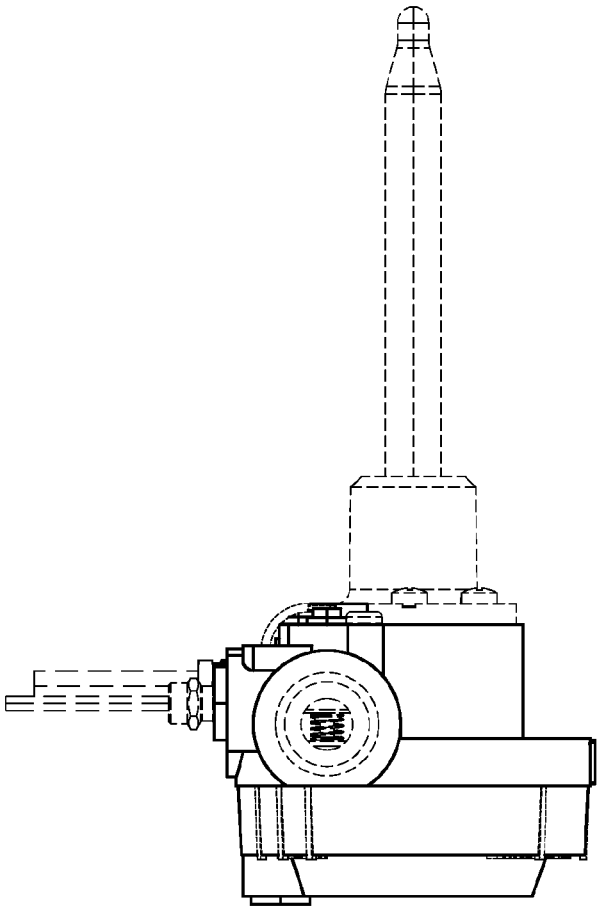
FIG. 14 is side view of the gas valve assembly showing the side opposite of that shown in FIG. 12.
Figure 15:
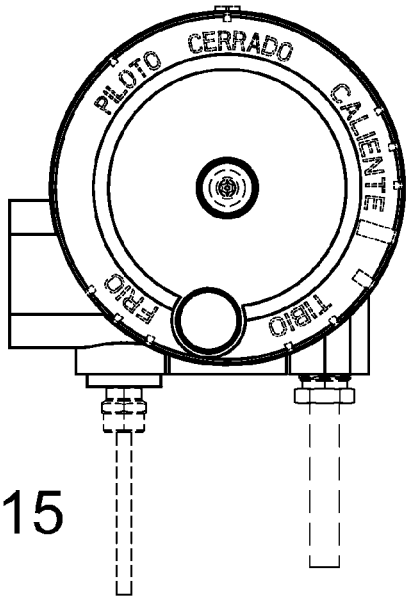
FIG. 15 is a front view of the gas valve assembly.

Even though rotating the dial 102 to PILOTO creates a gas flow path from the pilot valve port 132 to the pilot line 113, gas from the inlet 136 does not immediately flow to the pilot line 113. FIG. 8 illustrates a cross-sectional view of gas valve assembly 100, wherein, at the PILOTO position, a stem 188 attached to the reset button 107 in dial 102 is aligned with the safety magnet 182 and the magnet energizing shaft 184. The safety magnet 182 is disposed within the valve body 104, while the magnet energizing shaft 184 is disposed within the valve cover 144. Until the pilot flame is ignited, the safety magnet 182 remains in a closed position, which seals the safety magnet port 130 preventing gas flow into the pilot line 113 or into the outlet 140. A spring 186 biases the safety magnet 182 towards this closed position. A spring 190 biases the magnet energizing shaft 184 toward the stem 188 and away from the safety magnet 182.

When igniting the pilot flame, the reset button 107 is depressed, causing the stem 188 on the reset button 107 to push against the magnet energizing shaft 184, which, in turn, pushes against the safety magnet 182 causing it to unseal the safety magnet port 130. Moving the safety magnet 182 away from safety magnet port 130 allows gas from the inlet 136 to flow into the valve body 104 and to the pilot line 113 thereby allowing ignition of the pilot flame. The pilot flame heats the thermocouple 117, which generates an electrical current therein. A wire 192 provides a conductive path for the electrical current from the thermocouple 117 to the safety magnet 182. The electrical current energizes the safety magnet 182 causing it to move against the force of the spring 186 and away from the safety magnet port 130. In this manner, as long as the pilot flame burns, the safety magnet 182 will remain energized in the open position allowing gas from the inlet 136 to flow to the pilot valve port 132 and to the outlet port 134.

In addition to eliminating the need for the gas cock found on conventional gas valves, the gas valve assembly 100 also includes a safety feature, wherein the pilot valve 172 is configured to shut off the flow of gas to the pilot line 113, and therefore to the outlet 140 when the dial 102 is melted or destroyed by fire. In such a circumstance, a main burner of a water heater (not shown) would be shut off until the fire is extinguished. In normal operation, the pilot valve 172 is held in the open position by the ridge 120 on the back side 115 of dial 102. When the dial 102 is made of plastic, a fire in the vicinity of the gas valve 100 could cause the dial 102 to melt. In such an event, the ridge 120 would cease to hold the pilot valve 172 in the open position. The biasing spring 174 would cause the pilot valve 172 to close extinguishing the pilot flame, which would de-energize the safety magnet 182, thereby shutting off the flow of gas to the outlet 140 and to the main burner of the water heater. In this manner, the flow of gas to the water heater is prevented until the fire is extinguished and safe operating conditions are restored.

When the dial 102 is rotated to one of the temperature settings, the pilot valve 172 remains essentially unchanged in the open position, thus permitting gas flow to the pilot line 113. Referring to FIG. 5, it can be seen that the rotation of dial 102 also rotates the temperature adjustment screw 154 via gear 156 and gear 114 on the dial 102. When the dial 102 is rotated from PILOTO to the first temperature setting, FRIO, the temperature adjustment screw 154 rotates such that it threads into opening 148 causing the tip 178 to push against the lever 158. As a result, the end of the lever 158 contacting the tip 178 moves toward the shank 106. The lever 158 is configured to pivot such that as the end contacting the tip 178 moves toward the shank 106, the end of the lever 158 contacting the invar rod 160 moves away from the shank 106 and toward the diaphragm 164.

Depending on the temperature calibration of the temperature probe assembly 162, at some threshold temperature, for example 60 degrees Fahrenheit, when the temperature of the water in the water tank falls below the threshold temperature, the copper tube 161 in the temperature probe assembly 162 contracts causing the invar rod 160 to push against the lever 158, which, in turn, pushes against the diaphragm 164 causing the diaphragm 164 to collapse. The collapsing diaphragm 164 causes the seal 165 to move away from the outlet port 134, thus allowing gas to flow from the inlet 136 through the outlet port 134 to the outlet 140 and to the main burner for the water heater (not shown).

When the dial 102 is rotated to the second temperature setting, TIBIO, the temperature adjustment screw 154 is threaded further into the opening 148 causing the tip 178 to move one end of the lever closer to the shank 106, while causing the end contacting the invar rod 160 to move more toward the diaphragm 164. In this example, as a result of this movement of the lever 158 toward the diaphragm 164, the invar rod 160 does not have to move as much as in the previous example to cause the diaphragm 164 to collapse. Accordingly, the threshold temperature of the water in the tank does not have to drop as low as the 60 degrees Fahrenheit in the previous example to cause the diaphragm 164 to collapse and allow gas to flow from the outlet port 134 to the outlet 140 and to the main burner. For example, the threshold water temperature for the TIBIO setting may be 90 degrees Fahrenheit.

In the same manner, rotating the dial 102 to the third temperature setting, CALIENTE, may raise the threshold temperature, for example, to 120 degrees Fahrenheit. At this temperature setting, when the water temperature falls below 120 degrees Fahrenheit, the movement of the invar rod 160 pushes against the lever 158 collapsing the diaphragm 164 and allowing gas to flow to the main burner.

FIGS. 9-15 illustrate the aesthetic properties of the new, original, and ornamental design for the gas valve assembly.

Figure 16:
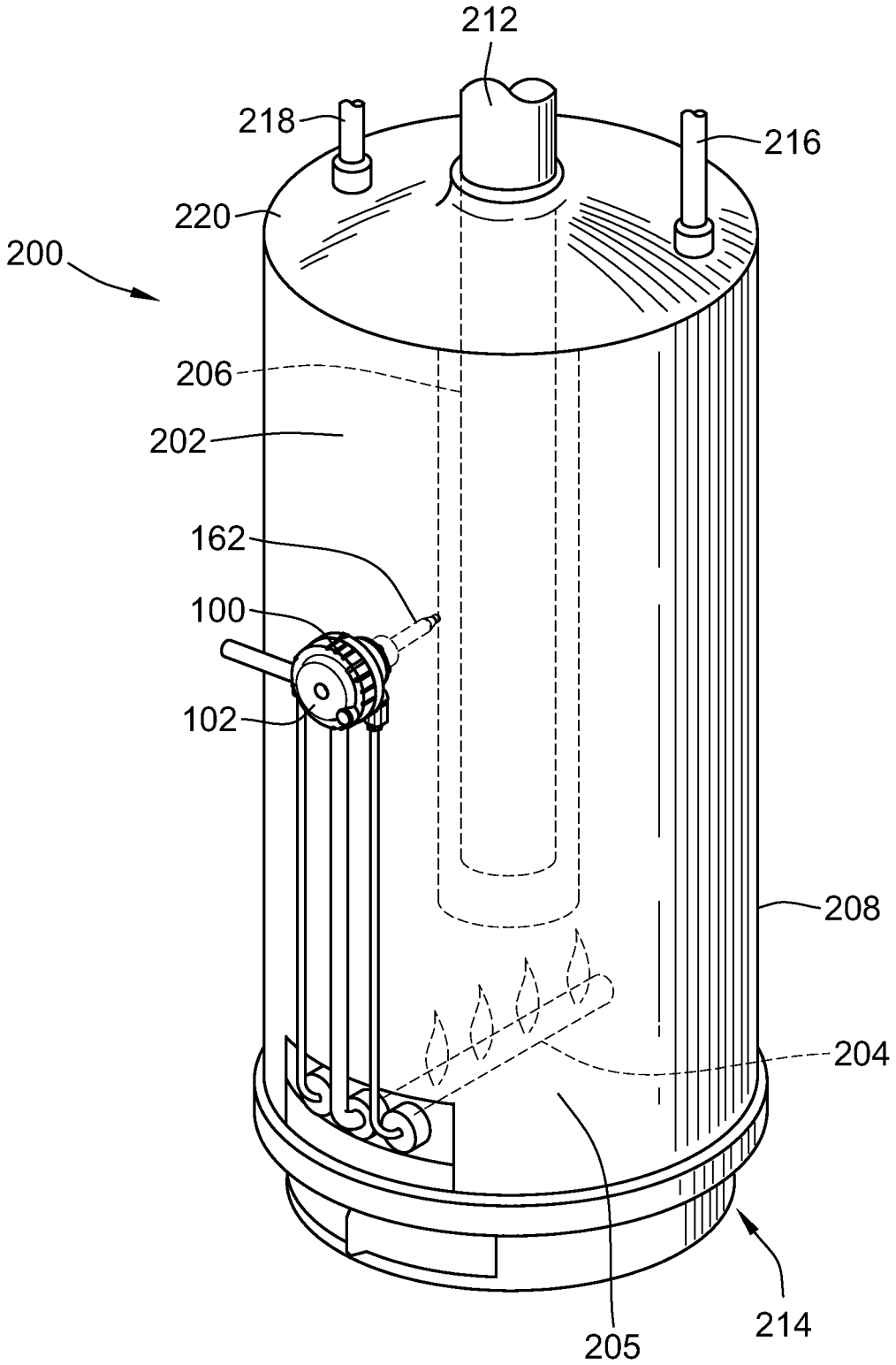
FIG. 16 is a pictorial illustration of a water heater that incorporates an embodiment of the invention.

FIG. 16 illustrates a gas-fired water heater 200 that incorporates an embodiment of the invention. It should be noted that the water heater 200 shown in FIG. 16 is an example storage-type gas water heater incorporating aspects of the invention and that other constructions for a gas water heating system are possible. The water heater 200 includes a cylindrical storage tank 202 for storing the water to be heated by a burner 204 within a combustion chamber 205 located at the bottom of the water heater 200 along with a flue 206, which provides a means for evacuation of burner gases. The housing 208 around the storage tank 202 is typically in the form of an insulated round jacket to prevent heat loss though the exterior surface of the tank 202. The heat from the burner 204 is exchanged with the water in the storage tank 202 via the flue pipe 206 that leads from the burner 204 through the storage tank 202 to an outlet 212 located on the top of the hot water heater 100. The water heater 200 includes a base pan 214 supporting the water tank 202 and housing 208. A cold water inlet tube 216 and a hot water outlet tube 218 extend through a top wall 220 of the water tank 202.

The gas valve 100 of FIG. 1 is attached to the storage tank 202, and as explained above, the dial 102 (shown in FIG. 2) can perform the functions of the gas cock on a conventional gas valve, namely to prevent gas from flowing to the water heater 200 or permit gas to flow to the water heater 200 to establish a safe pilot flame for burner 204 ignition. The gas valve 100 includes a thermocouple 117 (shown in FIG. 8) to sense the presence of the pilot flame, and energize the safety magnet to permit gas to flow the burner 204. As discussed above, the dial 102 can also select the temperature setting for water in the storage tank 202. The temperature probe assembly 162 (shown in FIG. 5) is assembled into an opening in the storage tank 202. The temperature probe assembly 162 is calibrated in accordance with the temperature settings on the dial 102. When the temperature of the water in the storage tank 202 drops below a threshold temperature corresponding to the selected temperature setting, the gas valve supplies gas to light the pilot light and operate the burner 208 to heat the water in the tank 202.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An unregulated gas valve for a water heater comprising:
an inlet configured to receive a gas flow into the gas valve;
an outlet configured to direct a portion of the as flow to a combustion chamber;
a pilot line configured to direct a portion of the as flow to a pilot flame;
a dial configured to regulate the flow of gas into the gas valve, and further configured to select a water temperature setting; and
a pilot valve configured to shut off the flow of gas to the pilot line if the dial is melted by fire.

2. The unregulated gas valve of claim 1, further comprising a safety magnet configured to prevent gas from flowing into the gas valve when there is no pilot flame.

3. The unregulated gas valve of claim 2, further comprising a reset button that, when depressed, is configured to move the safety magnet and permit gas to flow to the pilot line.

4. The unregulated gas valve of claim 2, further comprising a thermocouple that, when heated by the pilot flame, provides an electrical current to the safety magnet causing the safety magnet to allow a flow of gas into the gas valve.

5. The unregulated gas valve of claim 4, wherein providing an electrical current to the safety magnet causes the safety magnet to permit gas to flow continuously to the pilot line and to the outlet.

6. An unregulated gas valve for a water heater comprising:
an inlet configured to receive a gas flow into the gas valve;
an outlet configured to direct a portion of the as flow to a combustion chamber;
a pilot line configured to direct a portion of the as flow to a pilot flame;
a dial configured to regulate the flow of gas into the gas valve, and further configured to select a water temperature setting;
wherein the dial is configured to rotate to a first position that prevents gas from flowing into the gas valve, and configured to rotate to a second position that permits the flow of gas to the pilot line.

7. The unregulated gas valve of claim 6, wherein the dial further includes a plurality of markings on a perimeter wall, wherein the alignment of one of the plurality of markings with a fixed reference on the gas valve corresponds to a water temperature setting.

8. The unregulated gas valve of claim 7, wherein the plurality of markings include markings that correspond to water temperature settings for cold, warm and hot.

9. An unregulated gas valve for a water heater comprising: an inlet configured to receive a gas flow into the gas valve; an outlet configured to direct a portion of the gas flow to a combustion chamber; a pilot line configured to direct a portion of the gas flow to a pilot flame; a dial configured to regulate the flow of gas into the gas valve, and further configured to select a water temperature setting; wherein the dial includes an integral gear configured to operate a temperature adjustment screw; a shank having a longitudinal axis, the shank configured to support a temperature probe assembly.

10. The unregulated gas valve of claim 9, wherein the longitudinal axis is also the central axis of the dial.

11. A gas valve comprising:

a valve body configured to provide a flow path for a gas;

a safety magnet disposed within the valve body, wherein the safety magnet, in a first position, is configured to prevent a flow of gas into the valve body, and wherein the safety magnet, in a second position, is configured to permit the flow of gas into the valve body;

a pilot valve disposed within the valve body, wherein the pilot valve, in a first position, is configured to prevent the flow of gas to a pilot line, and wherein the pilot valve, in a second position, is configured to permit the flow of gas to the pilot line;

a temperature adjustment screw disposed within the valve body, the temperature adjustment screw configured to vary a water temperature setting; and a dial configured to control a position of each of the temperature adjustment screw, the pilot valve, and the safety magnet.

12. The gas valve of claim 11, wherein the pilot valve is further configured to prevent the flow of gas to the pilot line if the dial is melted by a fire.

13. The gas valve of claim 11, wherein the dial includes a gear configured to engage and rotate the temperature adjustment screw.

14. The gas valve of claim 13, wherein the temperature adjustment screw includes an adjustment screw gear to engage the gear on the dial.

15. The gas valve of claim 11, further comprising a shank configured to support a temperature probe assembly, wherein a center of the shank is aligned with a center of the dial.

16. The gas valve of claim 11, wherein the dial, in a first position, is configured to cause the pilot valve and safety magnet to prevent the flow of gas into the valve body, and wherein the dial, in a second position, is configured to cause the pilot valve to permit the flow of gas into the valve body to the pilot line.

17. The gas valve of claim 16, further comprising a reset button disposed within the dial, wherein the reset button is configured to move the safety magnet so that gas will flow to the pilot line when the dial is in the second position.

18. The gas valve of claim 11, further comprising a thermocouple that, when heated, provides an electrical current to energize the safety magnet and allow gas to flow into the valve body.

19. The gas valve of claim 18, wherein the thermocouple is configured to be heated by a pilot flame.

20. The gas valve of claim 19, wherein the pilot flame causes the safety magnet to move to, or remain in, the second position.

21. The gas valve of claim 11, wherein the absence of a pilot flame causes the safety magnet to move to, or remain in, the first position.

22. A water heating system comprising:

a water tank;

a combustion chamber adjacent to the water tank;

and a gas valve comprising:

a valve body configured to provide a flow path for a gas;

a safety magnet disposed within the valve body, wherein the safety magnet, in a first position, is configured to prevent a flow of gas into the valve body, and wherein the safety magnet, in a second position, is configured to permit the flow of gas into the valve body;

a pilot valve disposed within the valve body, wherein the pilot valve, in a first pilot valve position, is configured to prevent the flow of gas to a pilot line, and wherein the pilot valve, in a second pilot valve position, is configured to permit the flow of gas to the pilot line;

a temperature adjustment screw disposed within the valve body, the temperature adjustment screw configured to vary a water temperature setting; and a dial configured to control a position of each of the temperature adjustment screw, the pilot valve, and the safety magnet.

23. The water heater of claim 22, wherein the pilot valve is further configured to prevent the flow of gas to the pilot line if the dial is melted by a fire.

24. The water heater of claim 22, wherein the dial, in a first dial position, is configured to cause the pilot valve and safety magnet to prevent the flow of gas into the valve body, and wherein the dial, in a second dial position, is configured to cause the pilot valve to permit the flow of gas into the valve body to the pilot line.

25. The water heater of claim 24, wherein the gas valve further comprises a reset button disposed within the dial, wherein the reset button is configured to move the safety magnet so that gas will flow to the pilot line when the dial is in the second dial position.

26. The water heater of claim 22, wherein the gas valve further comprises a thermocouple that, when heated, provides an electrical current to energize the safety magnet and allow gas to flow into the valve body.

27. The water heater of claim 26, wherein the thermocouple is configured to be heated by a pilot flame.

28. The water heater of claim 27, wherein the pilot flame causes the safety magnet to move to, or remain in, the second position.

29. The water heater of claim 22, wherein the absence of a pilot flame causes the safety magnet to move to, or remain in, the first position.

* * * * *